US009913548B2

(12) United States Patent
Jacot et al.

(10) Patent No.: US 9,913,548 B2
(45) Date of Patent: Mar. 13, 2018

(54) AIR MATTRESS AND METHOD OF CONSTRUCTING SAME

(71) Applicant: CASCADE DESIGNS, INC., Seattle, WA (US)

(72) Inventors: Douglas S Jacot, Kingston, WA (US); James Edward Marson, Seattle, WA (US)

(73) Assignee: CASCADE DESIGNS, INC., Seattle, WA (US)

( * ) Notice: Subject to any disclaimer, the term of this patent is extended or adjusted under 35 U.S.C. 154(b) by 0 days.

(21) Appl. No.: 15/500,515

(22) PCT Filed: Jul. 24, 2015

(86) PCT No.: PCT/US2015/042121

§ 371 (c)(1),
(2) Date: Jan. 30, 2017

(87) PCT Pub. No.: WO2016/018768

PCT Pub. Date: Feb. 4, 2016

(65) Prior Publication Data

US 2017/0208959 A1 Jul. 27, 2017

Related U.S. Application Data

(60) Provisional application No. 62/030,055, filed on Jul. 28, 2014.

(51) Int. Cl.
*A47C 27/08* (2006.01)

(52) U.S. Cl.
CPC ..... *A47C 27/088* (2013.01); *A47C 27/084* (2013.01)

(58) Field of Classification Search
CPC ..... A47C 27/10; A47C 27/088
(Continued)

(56) References Cited

U.S. PATENT DOCUMENTS 2,326,441 A 8/1943 Cunningham
4,091,482 A * 5/1978 Malcolm ..... A47G 9/086 428/100

(Continued)

FOREIGN PATENT DOCUMENTS

EP 1082039 B1 1/2006
WO 2014130538 A1 8/2014

OTHER PUBLICATIONS

International Search Report and Written Opinion, PCT Application No. PCT/US15/42121, dated Oct. 28, 2015, 7 pages.

(Continued)

*Primary Examiner* — Fredrick C Conley
(74) *Attorney, Agent, or Firm* — P.G. Scott Born; Foster Pepper PLLC

(57) ABSTRACT

A method of constructing a mattress includes placing a first ribbon about a perimeter surface of a foam member. The first ribbon includes a top lip and a bottom lip. A second ribbon is placed about a perimeter surface of the first ribbon. A third ribbon is placed about a perimeter surface of the second ribbon. The top lip of the first ribbon is folded over the top surface of the second ribbon. The bottom lip of the first ribbon is folded over the bottom surface of the second ribbon. A first fabric panel is bonded to the top surface of the first foam member and to the top lip of the first ribbon. A second fabric panel is bonded to the bottom surface of the first foam member and to the bottom lip of the first ribbon.

17 Claims, 8 Drawing Sheets

(58) Field of Classification Search
USPC ..... 5/706, 709, 718, 655.3
See application file for complete search history.

(56) References Cited

U.S. PATENT DOCUMENTS

| | | | | |
|---|---|---|---|---|
| 5,033,133 | A * | 7/1991 | Nissen | A47C 7/021 5/653 |
| 7,107,641 | B2 | 9/2006 | Davis | |
| 7,147,106 | B2 | 12/2006 | Kowalski et al. | |
| 7,412,738 | B2 | 8/2008 | Chaffee | |
| 7,631,381 | B2 | 12/2009 | Flippin | |
| 8,955,182 | B1 | 2/2015 | Schiller et al. | |
| 2003/0200611 | A1 | 10/2003 | Chaffee | |
| 2005/0044634 | A1 | 3/2005 | Wang | |
| 2006/0174416 | A1 | 8/2006 | Wu | |
| 2009/0130373 | A1 | 5/2009 | Sharir | |
| 2014/0209184 | A1 | 7/2014 | Frayne | |
| 2014/0298589 | A1 | 10/2014 | Bailey | |

OTHER PUBLICATIONS

International Search Report and Written Opinion, PCT Application No. PCT/US16/20775, dated May 23, 2016, 8 pages.

* cited by examiner

AIR MATTRESS AND METHOD OF CONSTRUCTING SAME

PRIORITY CLAIM

This application claims priority to U.S. Provisional App. No. 62/030,055 filed Jul. 28, 2014, the entirety of which is incorporated by reference as if fully set forth herein.

BACKGROUND OF THE INVENTION

Most conventional air mattresses include a seam bonding the top and bottom fabric panels along their perimeters, resulting in mattresses with severely rounded perimeter edges at the top and bottom fabric panels when inflated. These finished mattresses are less comfortable because of smaller usable top and bottom surface area.

BRIEF DESCRIPTION OF THE DRAWING

Preferred and alternative embodiments of the present invention are described in detail below with reference to the following drawing figures in which.

DETAILED DESCRIPTION OF THE INVENTION

Improved air mattresses have more planar top and bottom fabric surfaces and vertically oriented perimeter fabric panels surrounding the mattress with a seam at the top and bottom of the perimeter panel.

In an embodiment, a fabric perimeter ribbon is placed around a planar block of foam with the bondable surface in toward the block. The fabric ribbon's top and bottom edge extend beyond the top and bottom planes of the foam block. Next, a somewhat rigid, somewhat compliant rubber surround, the horizontal thickness of the bonded seam (for example, ¼") and the same height as the foam block is placed around the foam and fabric assembly. Next, a rigid, comparatively non-compliant, slightly lower-height surround is placed around the foam block, fabric ribbon and rubber band assembly. The protruding top and bottom edges of the fabric ribbon are folded back over the top and bottom edges of the rubber surround so the bondable side is exposed to the top and bottom planes of the assembled components.

A fabric panel, coating side toward the foam block, is bonded to the upper plane of the foam block and to the upper folded back lip of the fabric perimeter ribbon creating an upper fabric bond to the foam block and a seam bond to the perimeter fabric ribbon. A second fabric panel is bonded to the lower plane of the foam block and lower folded back lip of the perimeter ribbon. The upper and lower seams are now complete. The rigid surround and the rubber hand are removed, leaving the bonded foam fabric mattress. The excess top and bottom fabric panels are trimmed back to the seams.

Figure 1:
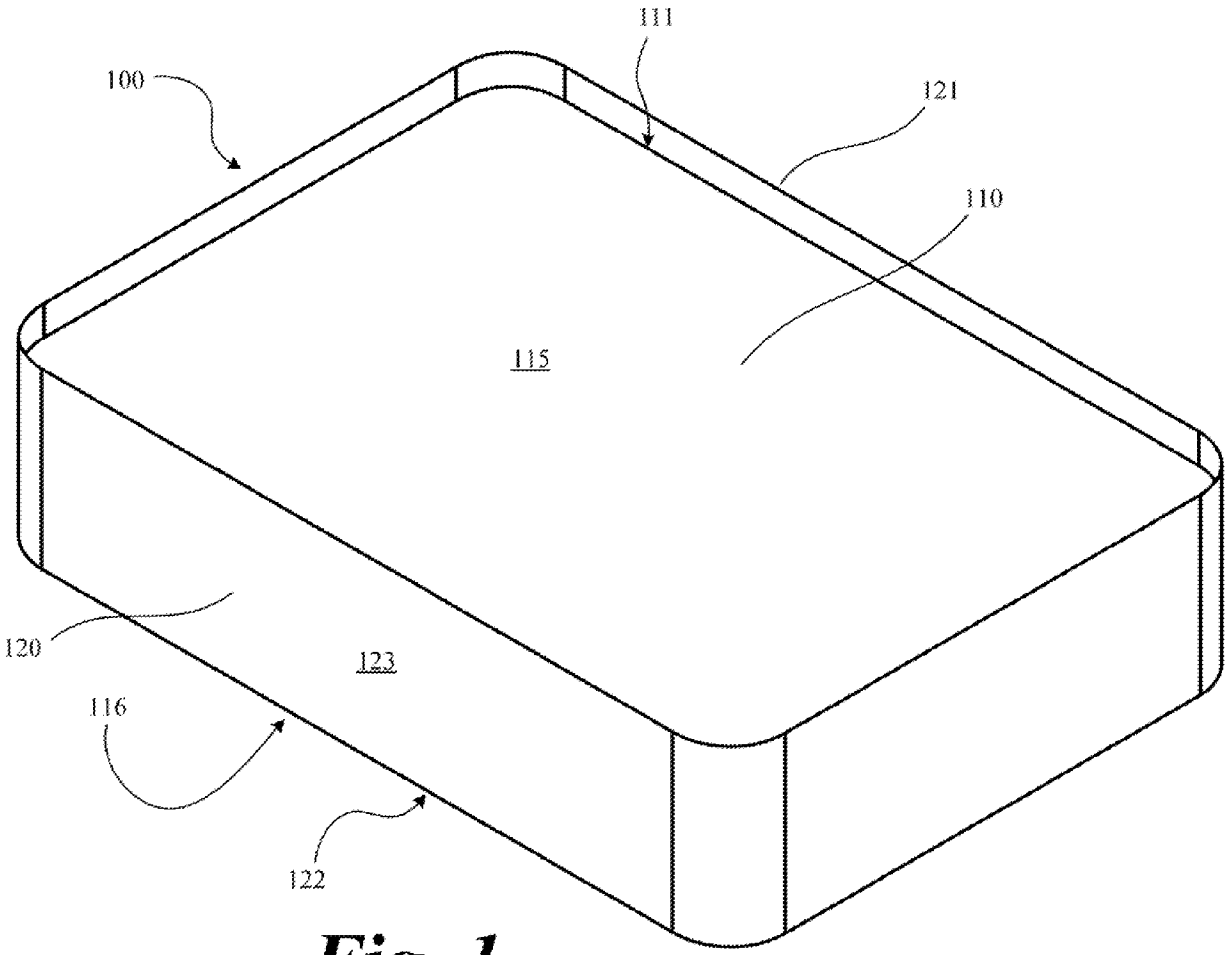
FIGS. 1-4 illustrate a top perspective view of construction of a mattress according to an embodiment of the invention.

More particularly, and referring now to FIGS. 1-4, a method of constructing an inflatable mattress 100 according to an embodiment is illustrated and discussed. Referring specifically to FIG. 1, in the illustrated embodiment, a first ribbon 120, preferably of a predetermined fabric type and level of rigidity, is placed about a perimeter surface 111 of a foam member 110. The foam member 110 includes a top surface 115 and a bottom surface 116 substantially similar to and opposing the top surface. Top surface 115 and bottom surface 116 are disposed substantially perpendicular to the perimeter surface 111 of foam member 110. The first ribbon 120 includes a top lip 121 and a bottom lip 122 extending in a direction substantially parallel to the perimeter surface 111 and beyond the top and bottom surfaces 115, 116, respectively, of the foam member 110.

Figure 2:
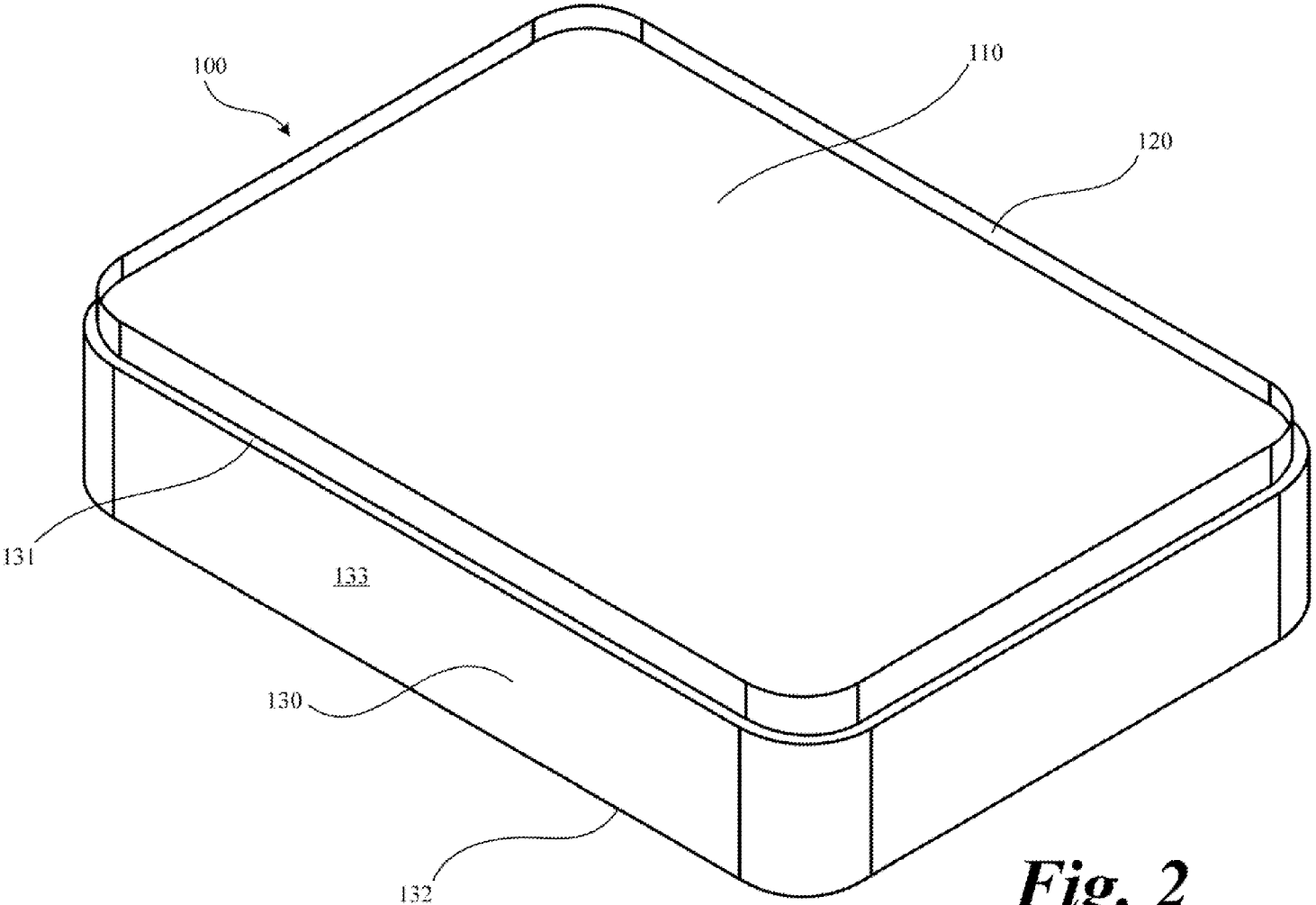

Referring to FIG. 2, a second ribbon 130 of a rigidity level greater than that of the first ribbon 120 is placed about a perimeter surface 123 (FIG. 1) of the first ribbon 120. The perimeter surface 123 of first ribbon 120 is substantially co-planar with the perimeter surface 111 of the foam member 110. The second ribbon 130 is substantially the same height as the perimeter surface 111 of the foam member 110. The second ribbon 130 includes top and bottom surfaces 131, 132 extending in a direction substantially perpendicular to the perimeter surface 111 of the foam member 110.

Figure 3:
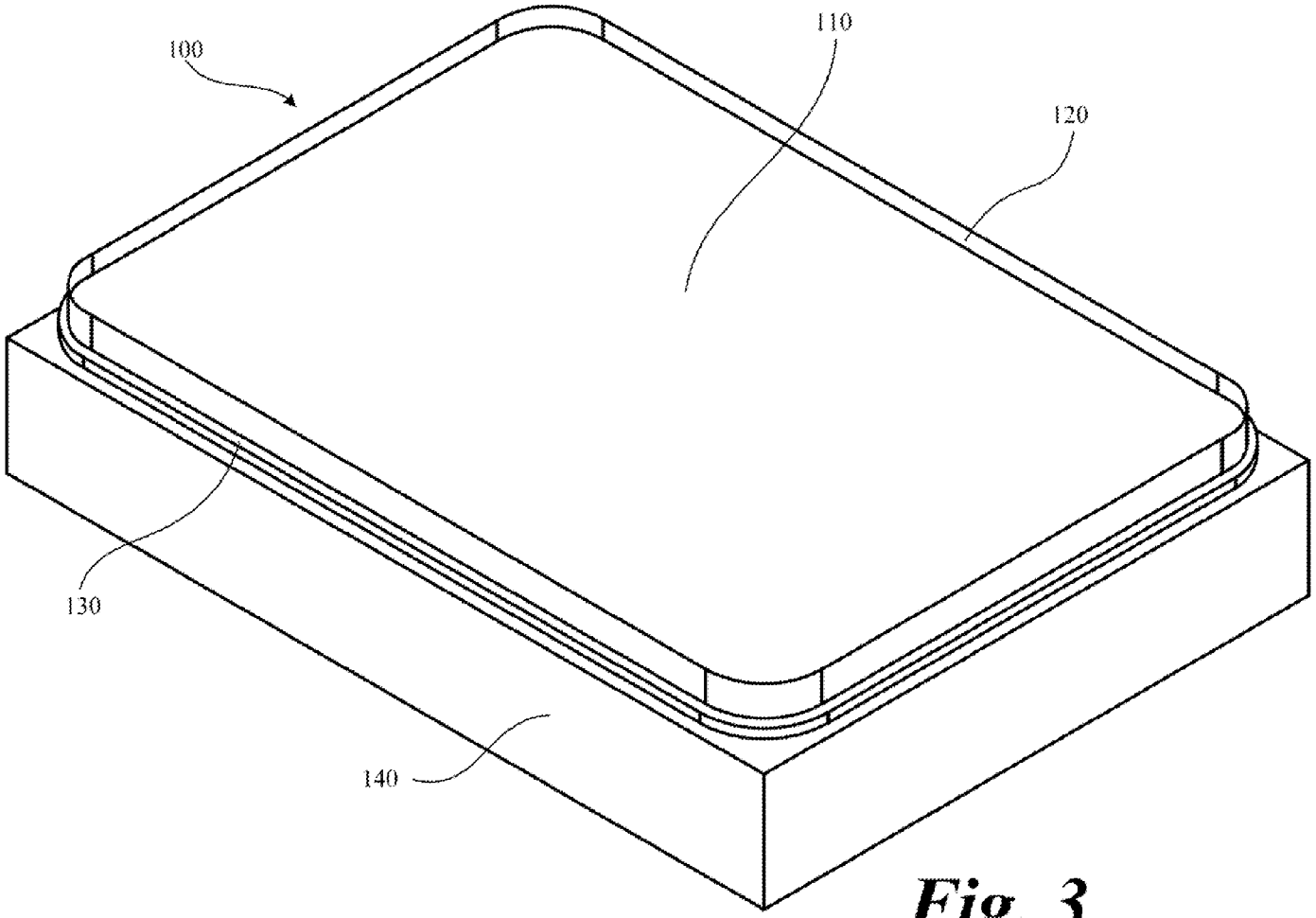

Referring to FIG. 3, a third ribbon 140 of a rigidity level greater than that of the second ribbon 130 is placed about a perimeter surface 133 (FIG. 2) of the second ribbon 130. The perimeter surface 133 of the second ribbon 130 is substantially co-planar with the perimeter surface 111 of the foam member 110. Subsequently, the top lip 121 of the first ribbon 120 is folded over the top surface 131 of the second ribbon 130 away from the foam member 110, and the bottom lip 122 of the first ribbon is folded over the bottom surface 132 of the second ribbon, also away from the foam member.

Figure 4:
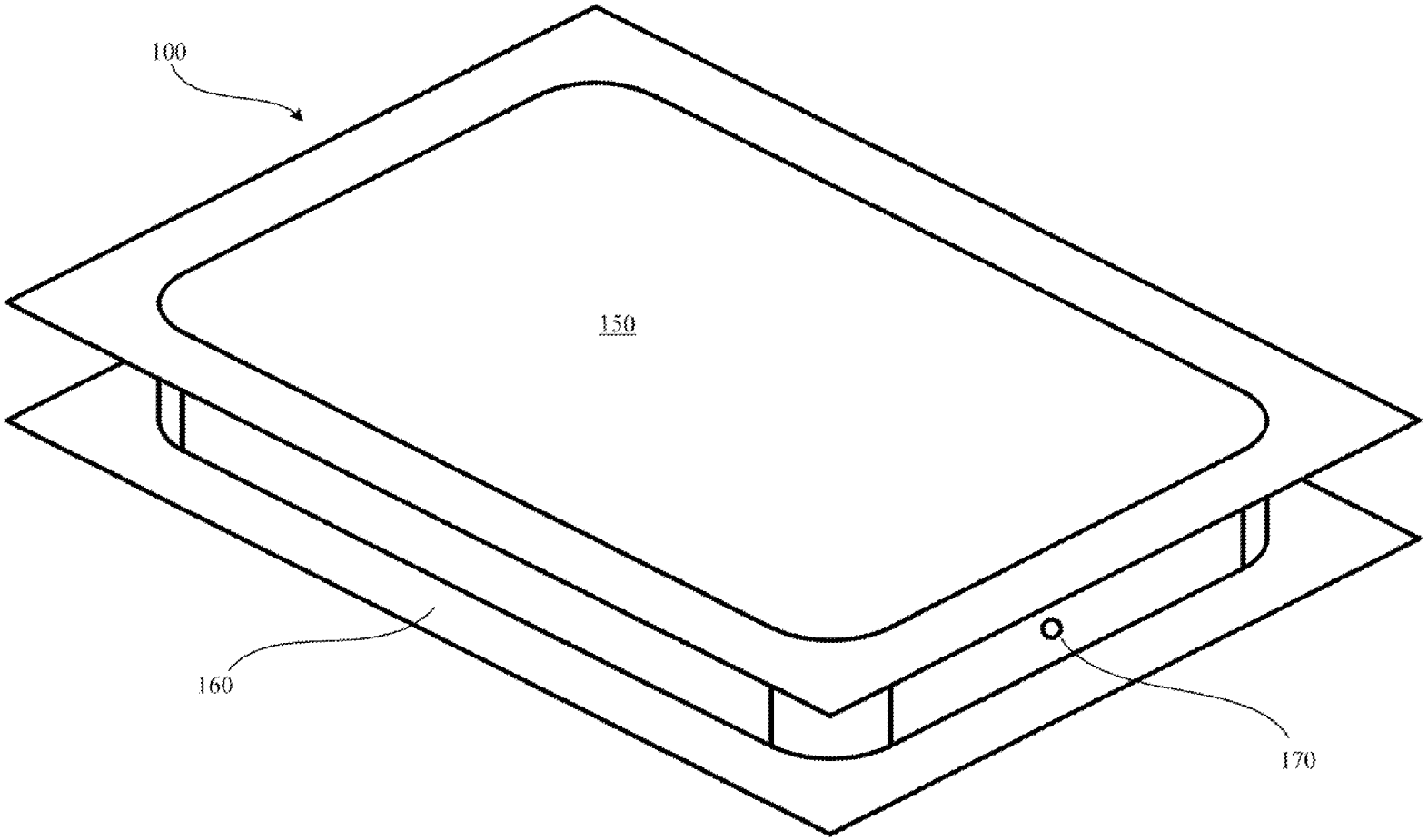

Referring to FIG. 4, a first fabric panel 150 is then bonded to the top surface 115 of the foam member 110 and to the top lip 121 of the first ribbon 120. A second fabric panel 160 is bonded to the bottom surface 116 of the foam member 110 and to the bottom lip 122 of the first ribbon 120. The third ribbon 140 is then removed from its position about the second ribbon 130, and the second ribbon is removed from its position about the first ribbon 120. A pneumatic valve 170 is formed through the first ribbon 120, as illustrated in FIG. 4, or can alternatively be formed through the first or second fabric panel 150, 160.

The excess material of first and second fabric panels 150, 160 can be trimmed back to the seams of mattress 100 formed by the bonding process described above.

Figure 5:
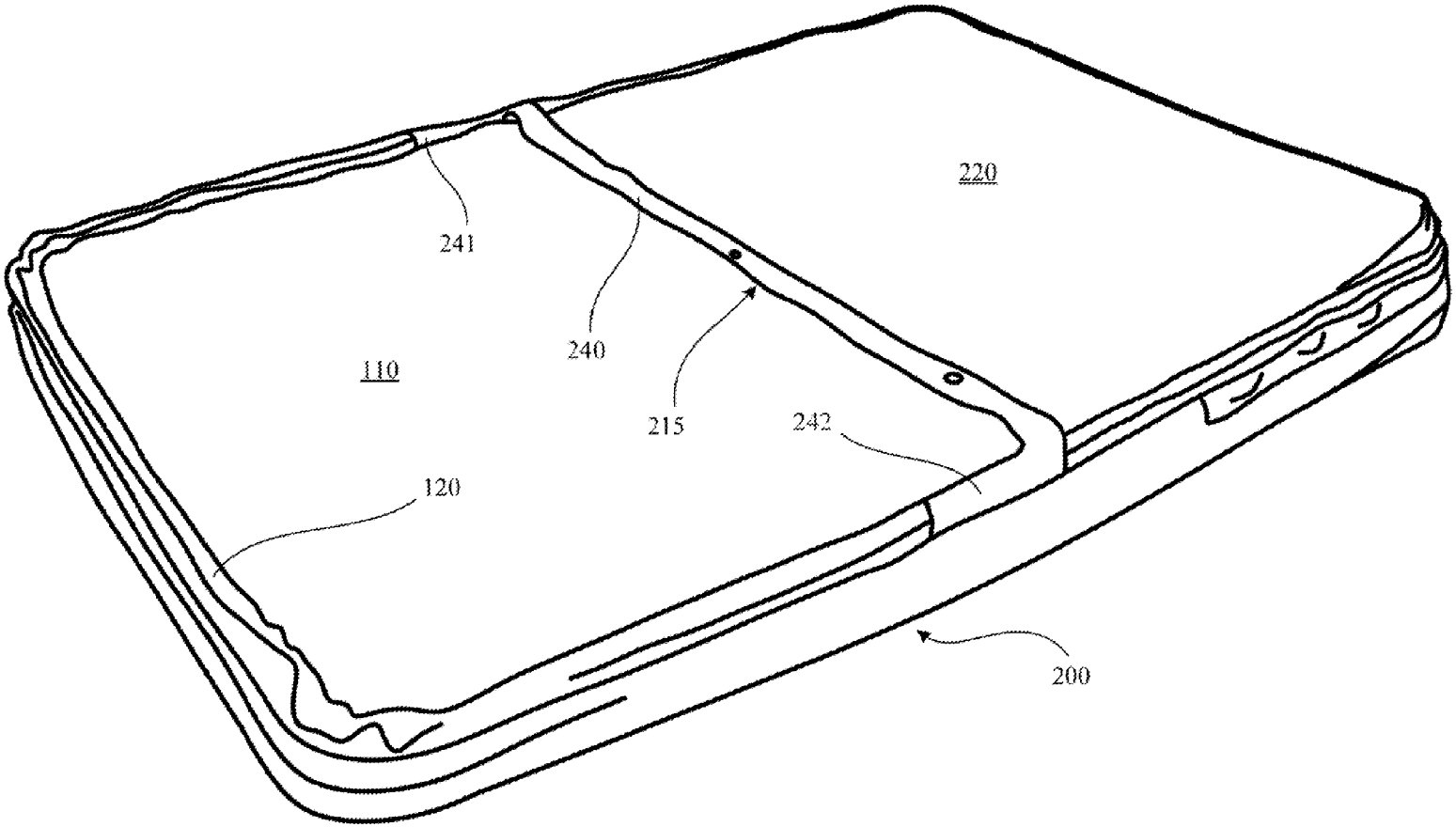
FIGS. 5-6 illustrate a top perspective view of construction of a mattress according to an alternative embodiment of the invention.
Figure 6:
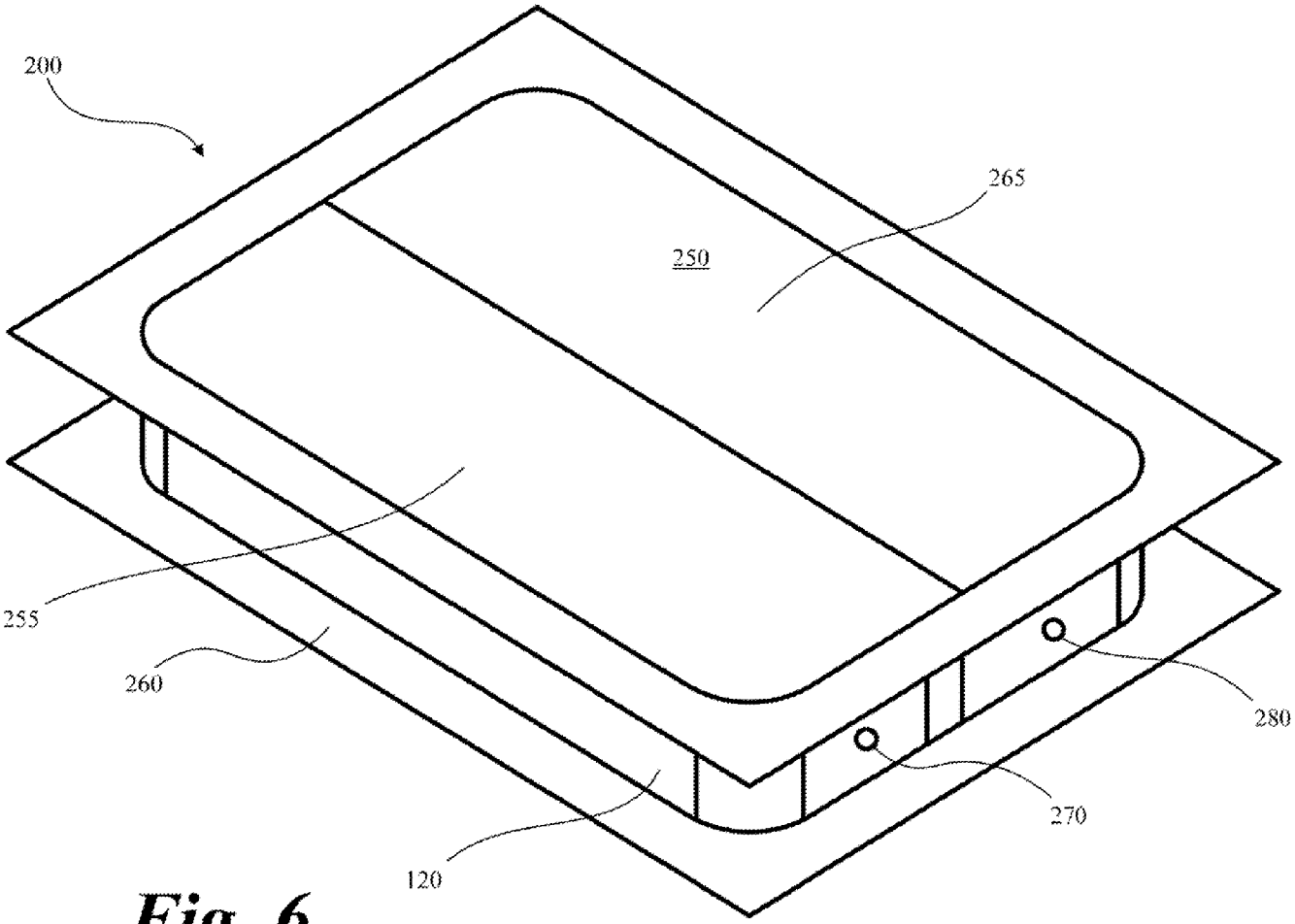

Referring now to FIGS. 5-6, a method of constructing an inflatable mattress 200 according to an alternative embodiment is illustrated and discussed. As the method of constructing the mattress 200 is, with the exception of the modifications discussed below, identical to that discussed with reference to FIGS. 1-4, like numerals are used in FIGS. 5-6 to designate like elements for purposes of clarity. As illustrated in FIG. 5, the first ribbon 120 is placed about foam member 110 and a perimeter surface of a second foam member 220 structurally similar, if not identical, to foam member 110. The second foam member 220 includes a top surface and a bottom surface disposed substantially perpendicular to the perimeter surface of the second foam member.

An air-impermeable high melt/low melt film member 240, disposed between foam member 110 and foam member 220, encloses the entirety of the perimeter side 215 of foam member 110 abutting foam member 220, overlaps portions of top surface 115 and bottom surface 116 of foam member 110, and is bonded to the first ribbon 120. As illustrated in FIG. 5, edges 241, 242 of film member 240 are folded in such manner as to extend and be bonded to first ribbon 120 along portions of the first ribbon lying perpendicular to perimeter side 215.

Subsequently, and in a manner at least similar to that in which fabric panels 150, 160 are bonded as discussed with reference to FIGS. 1-4, first and second fabric panels 250, 260 are bonded to the entireties of first ribbon 120 and film member 240. Consequently, a first chamber 255 containing the foam member 110 and a second chamber 265 containing foam member 220 are formed. The second chamber 265 is pneumatically sealed off from the first chamber 255 by the bonded combination of the first and second fabric panels 250, 260, first ribbon 120 and film member 240.

First and second pneumatic valves 270, 280 are formed through the first ribbon 120, as illustrated in FIG. 6, or can alternatively be formed through the first or second fabric panel 250, 260. The first and second pneumatic valves 270, 280 enable inflation and deflation of the first and second chambers 255, 265, respectively.

The excess material of first and second fabric panels 250, 260 can be trimmed back to the seams of mattress 200 formed by the bonding process described above.

Figure 7:
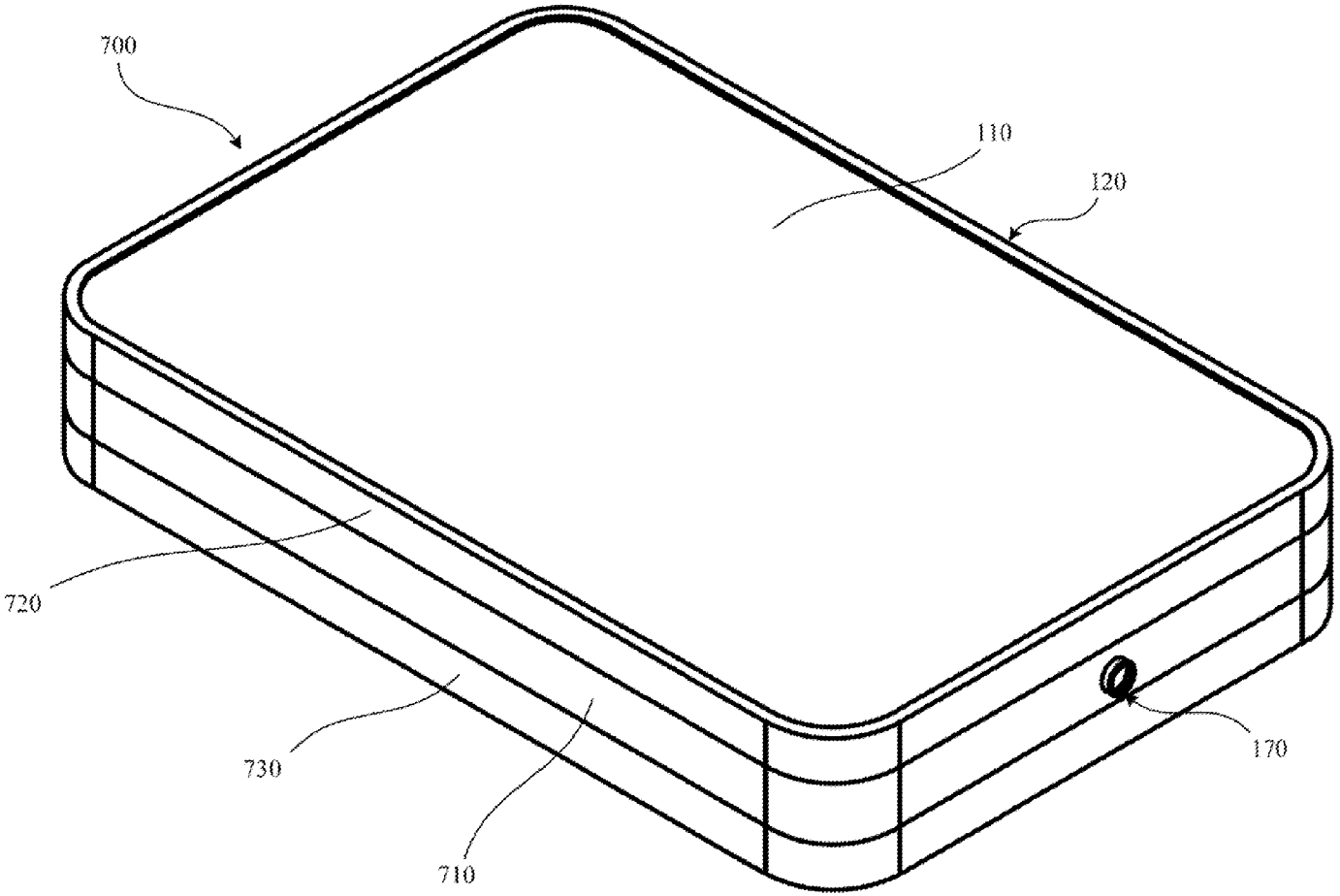
FIGS. 7-8 illustrate a top perspective view of mattress construction according to additional alternative embodiments of the invention.
Figure 8:
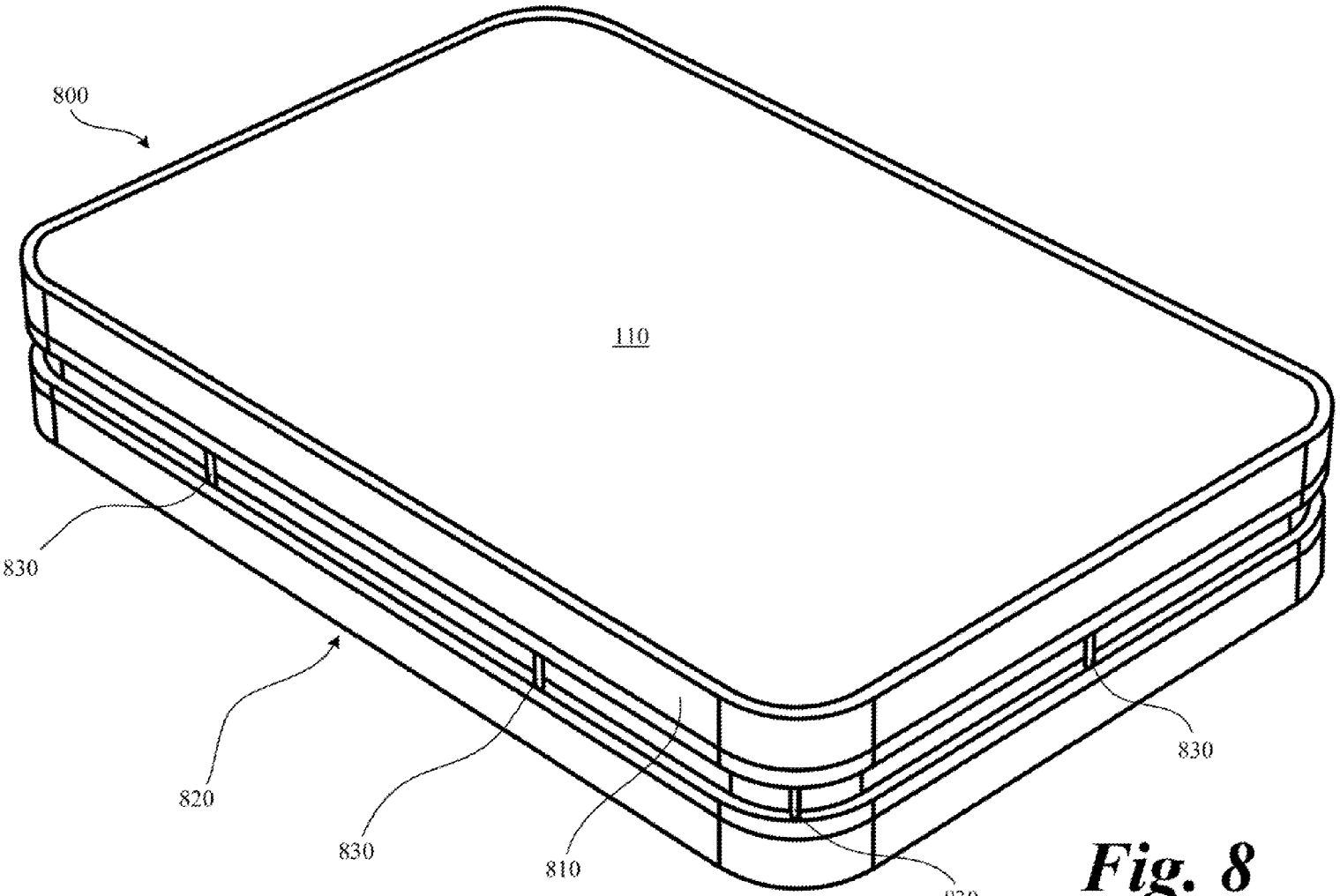

Referring now to FIGS. 7-8, methods of constructing an inflatable mattress according w alternative embodiments are illustrated and discussed. As the methods of constructing the mattress is, with the exception of the modifications discussed below, identical to that discussed with reference to FIGS. 1-4, like numerals are used in FIGS. 7-8 to designate like elements for purposes of clarity.

Referring to FIG. 7, a single unitary ribbon 700 including features of both the second and third ribbons 130, 140 may be used instead of the second and third ribbons. The unitary ribbon 700 may take the form of a surround having a central portion 710 of the rigidity of the third ribbon 140 and compliant (e.g., rubber) top and bottom edges 720, 730 of the rigidity of the second ribbon 130. The first ribbon 120 can be folded over edges 720, 730 in a manner similar to that discussed above with reference to second ribbon 130.

Referring to FIG. 8, a single unitary ribbon 800 including features of one or more of the second and third ribbons 130, 140 may be used instead of the second and third ribbons. The unitary ribbon 800 may take the form of a surround having top and bottom portions 810, 820 of the rigidity of the second ribbon 130 and/or third ribbon 140. Ribbon 800 further includes a set of biasing devices such as, for example, springs 830 connecting the top and bottom portions 810, 820, thereby enabling compression of ribbon 800 (i.e., movement of top and bottom portions 810, 820 toward one another). The first ribbon 120 can be folded over top and bottom portions 810, 820 in a manner similar to that discussed above with reference to second ribbon 130.

Different arrangements of the components depicted in the drawings or described above, as well as components and steps not shown or described are possible. Similarly, some features and subcombinations are useful and may be employed without reference to other features and subcombinations. Embodiments of the invention have been described for illustrative and not restrictive purposes, and alternative embodiments will become apparent to readers of this patent. Accordingly, the present invention is not limited to the embodiments described above or depicted in the drawings, and various embodiments and modifications can be made without departing from the scope of the claims below.

What is claimed is:

1. A method of constructing a mattress, comprising the steps of:

placing a first ribbon of a first rigidity about a perimeter surface of a first foam member, the first foam member further comprising a top surface and a bottom surface, the top surface and the bottom surface of the first foam member disposed substantially perpendicular to the perimeter surface of the first foam member, the first ribbon comprising a top lip and a bottom lip extending in a direction substantially parallel to the perimeter surface and beyond the top and bottom surfaces, respectively, of the first foam member;

placing a second ribbon about a perimeter surface of the first ribbon, the perimeter surface of the first ribbon substantially co-planar with the perimeter surface of the first foam member, the second ribbon comprising top and bottom surfaces extending in a direction substantially perpendicular to the perimeter surface of the first foam member;

placing a third ribbon about a perimeter surface of the second ribbon, the perimeter surface of the second ribbon substantially co-planar with the perimeter surface of the first foam member;

folding the top lip of the first ribbon over the top surface of the second ribbon;

folding the bottom lip of the first ribbon over the bottom surface of the second ribbon;

bonding a first fabric panel to the top surface of the first foam member and to the top lip of the first ribbon;

bonding a second fabric panel to the bottom surface of the first foam member and to the bottom lip of the first ribbon;

removing the third ribbon from about the second ribbon; and removing the second ribbon from about the first ribbon.

2. The method of claim 1, wherein the first ribbon comprises fabric.

3. The method of claim 1, wherein the second ribbon is of a second rigidity greater than the first rigidity.

4. The method of claim 3, wherein the third ribbon is of a third rigidity greater than the second rigidity.

5. The method of claim 1, wherein the second ribbon is substantially the same height as the perimeter surface of the foam member.

6. The method of claim 1, further comprising forming a pneumatic valve through at least one of the first ribbon and the first fabric panel.

7. The method of claim 1, further comprising placing the first ribbon about a perimeter surface of a second foam member, the second foam member further comprising a top surface and a bottom surface, the top surface and the bottom surface of the second foam member disposed substantially perpendicular to the perimeter surface of the second foam member.

8. The method of claim 7, further comprising bonding a film member to the first ribbon and the first and second fabric panels, whereby a first chamber containing the first foam member and a second chamber containing the second foam member are formed, the second chamber being pneumatically sealed off from the first chamber.

9. The method of claim 8, further comprising forming first and second pneumatic valves through at least one of the first ribbon and the first fabric panel, the first and second pneumatic valves enabling inflation and deflation of the first and second chambers, respectively.

10. A mattress, comprising:

a first foam member having a perimeter surface, a top surface and a bottom surface, the top surface and the bottom surface disposed substantially perpendicular to the perimeter surface of the first foam member;

a first fabric panel bonded to the top surface of the first foam member;

a second fabric panel bonded to the bottom surface of the first foam member; and a fabric ribbon disposed about, but not bonded to, the entirety of the perimeter surface of the first foam member, the ribbon comprising a top lip and a bottom lip extending in a direction substantially parallel to the perimeter surface and beyond the top and bottom surfaces, respectively, of the first foam member, the top lip bonded to the first fabric panel about the entirety of the perimeter surface, the bottom lip bonded to the second fabric panel about the entirety of the perimeter surface.

11. The mattress of claim 10, further comprising a pneumatic valve formed through at least one of the ribbon and the first fabric panel.

12. The mattress of claim 11, wherein the valve is a self-inflating valve.

13. The mattress of claim 10, further comprising a second foam member having a perimeter surface of, the second foam member further comprising a top surface and a bottom surface, the top surface and the bottom surface of the second foam member disposed substantially perpendicular to the perimeter surface of the second foam member.

14. The mattress of claim 13, further comprising a film member bonded to the ribbon and the first and second fabric panels, whereby a first chamber containing the first foam member and a second chamber containing the second foam member are formed, the second chamber being pneumatically sealed off from the first chamber.

15. The mattress of claim 14, further comprising first and second pneumatic valves formed through at least one of the ribbon and the first fabric panel, the first and second pneumatic valves enabling inflation and deflation of the first and second chambers, respectively.

16. A method of constructing a mattress, comprising the steps of:

placing a first ribbon of a first rigidity about a perimeter surface of a first foam member, the first foam member further comprising a top surface and a bottom surface, the top surface and the bottom surface of the first foam member disposed substantially perpendicular to the perimeter surface of the first foam member, the first ribbon comprising a top lip and a bottom lip extending in a direction substantially parallel to the perimeter surface and beyond the top and bottom surfaces, respectively, of the first foam member;

placing a second ribbon about a perimeter surface of the first ribbon, the perimeter surface of the first ribbon substantially co-planar with the perimeter surface of the first foam member, the second ribbon comprising top and bottom surfaces extending in a direction substantially perpendicular to the perimeter surface of the first foam member;

folding the top lip of the first ribbon over the top surface of the second ribbon;

folding the bottom lip of the first ribbon over the bottom surface of the second ribbon;

bonding a first fabric panel to the top surface of the first foam member and to the top lip of the first ribbon;

bonding a second fabric panel to the bottom surface of the first foam member and to the bottom lip of the first ribbon; and removing the second ribbon from about the first ribbon.

17. The method of claim 16, wherein the second ribbon comprises an upper portion and a lower portion, the upper portion being coupled to the lower portion by a set of biasing devices.

* * * * *